US011479926B2

(12) United States Patent
Nagel

(10) Patent No.: US 11,479,926 B2
(45) Date of Patent: Oct. 25, 2022

(54) SYSTEM AND METHOD FOR OPERATING A COMPACTOR

(71) Applicant: Caterpillar Paving Products Inc., Brooklyn Park, MN (US)

(72) Inventor: Brian D Nagel, Ramsey, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 145 days.

(21) Appl. No.: 16/986,856

(22) Filed: Aug. 6, 2020

(65) Prior Publication Data

US 2022/0042253 A1 Feb. 10, 2022

(51) Int. Cl.
*E01C 19/28* (2006.01)
*E01C 21/00* (2006.01)

(52) U.S. Cl.
CPC ..... *E01C 19/288* (2013.01); *E01C 19/282* (2013.01); *E01C 21/00* (2013.01)

(58) Field of Classification Search
CPC .... E01C 19/282; E01C 19/286; E01C 19/288; E01C 21/00
USPC ..... 404/84.05–84.8, 113, 117, 72, 75
See application file for complete search history.

(56) References Cited

U.S. PATENT DOCUMENTS 5,952,561 A 9/1999 Jaselskis et al.
6,236,923 B1 5/2001 Corcoran et al.
6,460,006 B1 * 10/2002 Corcoran ..... E01C 19/288 404/117
6,973,821 B2 12/2005 Corcoran
8,190,338 B2 * 5/2012 Commuri ..... E01C 19/288 701/50
9,903,077 B2 2/2018 Rio
2007/0239338 A1 * 10/2007 Potts ..... E02D 3/02 701/50
2008/0003057 A1 * 1/2008 Hall ..... E01C 19/288 404/84.1
2014/0348587 A1 * 11/2014 Corcoran ..... E01C 19/26 404/84.05
2016/0298308 A1 * 10/2016 Oetken ..... E01C 19/288
2017/0284036 A1 * 10/2017 Rio ..... E01C 19/288
2019/0094202 A1 3/2019 Troxler

FOREIGN PATENT DOCUMENTS

CN 110453573 A 11/2019

* cited by examiner

*Primary Examiner* — Raymond W Addie
(74) *Attorney, Agent, or Firm* — von Briesen & Roper, s.c.

(57) ABSTRACT

The disclosure is directed towards a system for compacting a work area. The system includes a compactor, a first compaction sensor positioned on a forward end of the compactor, a second compaction sensor positioned on a rearward end of the compactor, and a controller. The controller is configured to receive a first compaction data associated with the work area from the first compaction sensor. The controller is further configured to determine a first compaction effort based on the first compaction data and control the compactor to perform compaction with the determined first compaction effort. The controller is configured to receive a second compaction data associated with a compacted first portion from the second compaction sensor and determine a variance between the first and the second compaction data. Furthermore, the controller is configured to determine a correlation between the variance and the first compaction effort to determine a second compaction effort.

20 Claims, 3 Drawing Sheets

SYSTEM AND METHOD FOR OPERATING A COMPACTOR

TECHNICAL FIELD

The present disclosure relates, in general, to compactors, such as soil compactors, asphalt compactors, and utility compactors. More particularly, the present disclosure relates to a system and method for operating such compactors.

BACKGROUND

Compactors, such as soil compactors, asphalt compactors, and utility compactors, are often employed for performing a variety of compaction related tasks on a work area. Generally, a compactor may include a rotating drum assembly having a variable vibratory mechanism, which provides compaction effort, based on one or more characteristics (such as density, moisture, temperature, etc.) associated with the work area, to perform a compaction operation on that work area. The compaction effort generally depends on one or more operating parameters of the variable vibratory mechanism, such as amplitude and frequency. Typically, the compaction operation includes driving the compactor with a specific compaction effort over the work area multiple times (known as compaction passes) until it is compacted to target. Every compaction pass may change one or more characteristics of the work area, and hence the subsequent pass needs to be performed with a different compaction effort, thereby requiring modifications to the operating parameters of the vibratory mechanism.

These variations of compaction effort and modifications to the operating parameters of the vibratory mechanism, is generally done by an operator who relies on their own judgements and observations. However, manual determination of the operating parameters by the operators requires extensive training and is also prone to errors. Moreover, in case of uneven surfaces, having materials with different characteristics, it becomes challenging to determine appropriate operating parameters for the vibratory mechanism. An erroneous determination by the operator, in such cases, may result in the work area being unevenly compacted. Hence, the uneven compaction of the work area may lead to various portions of the work area being either under compacted or over compacted.

To this end, Chinese patent application 110453573A, relates to an electric intelligent vibration road roller system and a control method thereof. An acceleration sensor is fixed on a roller frame and is used to monitor the vibration acceleration and vibration frequency in a vertical direction of the frame, to identify compaction degree and detect vibration intensity of the road in real time.

SUMMARY OF THE INVENTION

In one aspect of the present disclosure, a system for compacting a work area is provided. The system includes a compactor for providing a compaction effort to the work area. The system includes a first compaction sensor, a second compaction sensor, and a controller. The first compaction sensor is positioned on a forward end of the compactor. The second compaction sensor is positioned on a rearward end of the compactor. The controller is operatively coupled to the first compaction sensor, the second compaction sensor, and the compactor. The controller is configured to receive a first compaction data associated with the work area from the first compaction sensor. The controller is further configured to determine a first compaction effort based on the first compaction data and control the compactor to perform compaction on the work area with the determined first compaction effort to obtain a compacted first portion of the work area. The controller is further configured to receive a second compaction data associated with the compacted first portion from the second compaction sensor and determine a variance between the first compaction data and the second compaction data. Furthermore, the controller is configured to determine a correlation between the determined variance and the first compaction effort. The controller is then configured to determine a second compaction effort for the work area based on a target compaction data associated with the work area and the determined correlation. The controller is configured to control the compactor to perform compaction on the work area with the determined second compaction effort.

In another aspect of the present disclosure, a method is provided for operating a compactor that provides a compaction effort over a work area. The method includes receiving a first compaction data associated with the work area from a first compaction sensor positioned on the forward end of the compactor. The method includes determining a first compaction effort based on the first compaction data. The method further includes controlling the compactor to perform compaction on the work area with the determined first compaction effort to obtain a compacted first portion of the work area. Further, the method includes receiving a second compaction data associated with the compacted first portion from a second compaction sensor positioned on the rearward end of the compactor. Furthermore, the method includes determining a variance between the first compaction data and the second compaction data and subsequently, a correlation between the determined variance and the first compaction effort. The method further includes determining a second compaction effort for the work area based on a target compaction data associated with the work area and the determined correlation. The method further includes controlling the compactor to perform compaction on the work area with the determined second compaction effort.

In a yet another aspect of the present disclosure, a compactor is provided. The compactor includes a frame, a compacting drum operably connected to the frame, a variable vibratory mechanism coupled to the compacting drum, a first compaction sensor, the second compaction sensor, and a controller. The variable vibratory mechanism is configured to provide a compaction effort to a work area. The first compaction sensor is positioned on a forward end of the frame and the second compaction sensor positioned on a rearward end of the frame. The controller is operatively coupled to the first compaction sensor, the second compaction sensor, and the variable vibratory mechanism. The controller is configured to receive a first compaction data associated with the work area from the first compaction sensor. The controller is further configured to determine a first compaction effort based on the first compaction data and control the variable vibratory mechanism to perform compaction on the work area with the determined first compaction effort to obtain a compacted first portion of the work area. The controller is further configured to receive a second compaction data associated with the compacted first portion from the second compaction sensor. The controller is further configured to determine a variance between the first compaction data and the second compaction data and subsequently a correlation between the determined variance and the first compaction effort. The controller is further configured to determine a second compaction effort for the work area based on a target compaction data associated with the work area and the determined correlation. The controller is further configured to control the variable vibratory mechanism to perform compaction on the work area with the determined second compaction effort.

DETAILED DESCRIPTION

Reference will now be made in detail to specific aspects or features, examples of which are illustrated in the accompanying drawings. Wherever possible, corresponding or similar reference numbers will be used throughout the drawings to refer to the same or corresponding parts.

Figure 1:
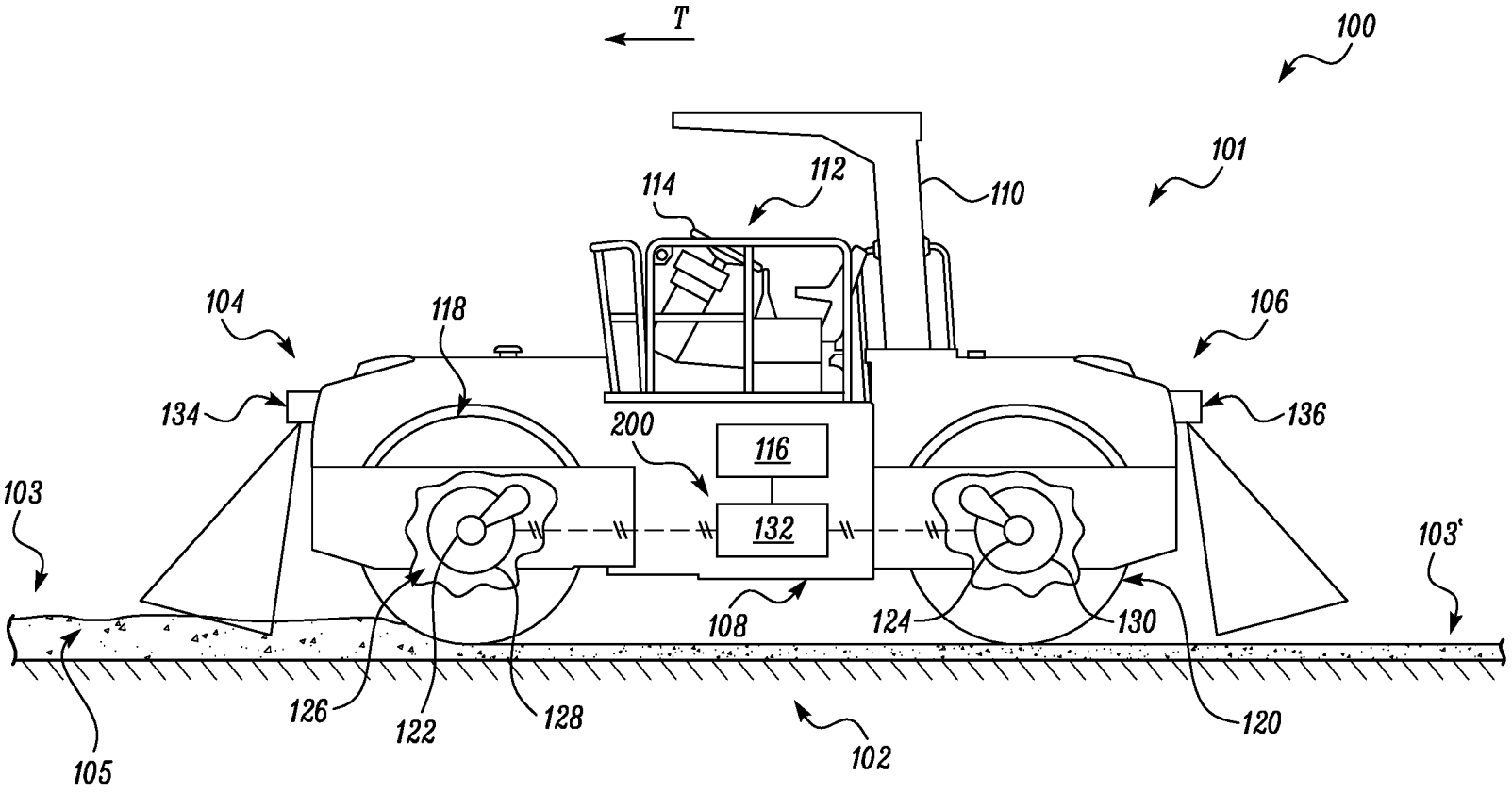
FIG. 1 illustrates an exemplary compactor operating at a worksite, in accordance with an embodiment of the present disclosure.

The present disclosure relates to a system and method for operating a compactor at a worksite. To this end, FIG. 1 illustrates an exemplary system 100, for operating a compactor 101 at a worksite 102, in accordance with an embodiment of the present disclosure. The compactor 101 may refer to any type of compactor machine used for compacting a paving material, such as, soil, sand, gravel, loose bedrock, asphalt, recycled concrete, bituminous mixtures, or any other compactable material. For example, the compactor 101 may include a rolling compactor, a plate compactor, a self-propelled compactor, a compactor towed behind a paving machine, or any other compaction device known in the art. In the illustration of FIG. 1, the compactor 101 is embodied as an asphalt compactor. However, those of skill in the art will recognize that any type of compactor may be used, such as a soil compactor, utility compactor, etc.

The compactor 101 may be configured to compact a work area 103, having loose paving material 105 disposed thereon. The work area 103 may be a part of a larger worksite 102. That is, the worksite 102 may be divided into multiple work areas 103. In some embodiments, multiple compactors 101 may be operating at the worksite 102 to complete a compaction operation. In some embodiments, the work area 103 may further be divided into smaller operational portions that are each compacted by the compactor 101 individually, as the compactor 101 operates to perform the compaction operation on the work area 103. As the compactor 101 travels over the work area 103, vibrational forces generated by the compactor 101 are imparted to the work area 103. These vibrational forces acting in cooperation with a weight of the compactor 101, compress the loose paving material 105 to a state of greater compaction and density. The compactor 101 may make one or more passes over the work area 103 to provide a desired level of compaction.

As shown in FIG. 1, the compactor 101 may define a forward end 104 and a rearward end 106 opposite to the forward end 104. The forward end 104 and the rearward end 106 may be defined in relation to an exemplary direction of travel T of the compactor 101, with said direction of travel T being defined exemplarily from the rearward end 106 towards the forward end 104.

The compactor 101 may include a frame 108 and an operator cab 110 supported on the frame 108. The operator cab 110 includes an operator seat and an operator console 112, that may include various input/output controls for operating the compactor 101. For example, the operator console 112 may include, but not limited to, one or more of steering wheels (such as steering wheel 114), an I/O unit, joysticks, switches etc., to facilitate an operator in operating the compactor 101 and one or more components of the compactor 101.

The compactor 101 may further include a power source 116. The power source 116 may by supported on the frame 108 and may be configured to provide mechanical and/or electrical power to the compactor 101. The power source 116 may include a variety of suitable types, such as, an internal combustion engine, an electric generator, a fluid pump, fuel cell, a battery or any other suitable device configured to power the compactor 101. In one example, the power source 116 may be configured to propel the compactor 101 at the worksite 102 and provide power to various components of the compactor 101.

The compactor 101 may include various components to facilitate the compaction operation, and further prevent de-compaction and crushing of the paving material 105 during the compaction operation. The compactor 101 may include one or more compacting elements, such as a first compacting drum 118 and a second compacting drum 120 operably connected to the frame 108. The first compacting drum 118 and the second compacting drum 120 may be rotatably supported on the frame 108 and operatively connected to a first motor 122 and a second motor 124, respectively, such that the first motor 122 may drive the first compacting drum 118 and the second motor 124 may drive the second compacting drum 120 to propel the compactor 101 on the work area 103. The first motor 122 and the second motor 124 may be configured to modify a speed of the compactor 101 by modifying a speed of rotation (hereinafter interchangeably referred to as rotational speed) of the first compacting drum 118 and the second compacting drum 120, respectively, depending on the requirements of the compaction operation. The motors 122, 124 may be powered by the power source 116. For example, the motors 122, 124 may be operably coupled to the power source 116 via electrical wires, fluid conduits, or any other suitable connection. In an exemplary implementation, where the power source 116 provides electrical power, the motors 122, 124 may be electric motors. Alternatively, where the power source 116 provides hydraulic power, the motors 122, 124 may be fluid motors.

In an embodiment, the compactor 101 may include a variable vibratory mechanism 126 coupled to the compacting drums 118, 120 and configured to provide a compaction effort to the work area 103. For example, the variable vibratory mechanism 126 may be disposed in connection with the first compacting drum 118 and the second compacting drum 120. As illustrated, the variable vibratory mechanism 126 includes a first vibratory mechanism 128 and a second vibratory mechanism 130 coupled to the first compacting drum 118 and the second compacting drum 120, respectively. Further, the first vibratory mechanism 128 and the second vibratory mechanism 130 may also be operatively connected to and driven by their respective motors (not shown) to provide a compaction effort for compacting the work area 103. In particular, the motors drive the first vibratory mechanism 128 and the second vibratory mechanism 130, to cause the respective compacting drums 118, 120 to vibrate with an appropriate frequency and amplitude, depending on the requirements of the compaction operation. It may be contemplated that the compaction effort is directly proportional to the amplitude of vibration, and usually inversely proportional to the frequency of vibration. Therefore, an increase in compaction effort demands an increase in amplitude of vibration, and vice-versa. Similarly, the increase in compaction effort corresponds to a decrease in frequency of vibration and vice-versa.

Further, it may be understood that the term "variable vibratory mechanism" may not be limited to mechanisms providing compaction effort using only vibrations of the compacting elements, but may also apply to other type of mechanisms which provide compaction effort using, for example, oscillatory or reciprocating movement of the compacting elements. In the subsequent paragraphs, the functioning of the variable vibratory mechanism 126 has been described in terms of the first vibratory mechanism 128. However, it may be contemplated that the same description applies to the second vibratory mechanism 130 as well.

In some examples, the first vibratory mechanism 128 may include one or more weights (not shown) disposed inside an interior volume of the first compacting drum 118. The one or more weights may be disposed at a position off-center from a common axis (not shown) around which the first compacting drum 118 rotates. That is, the weights are eccentrically positioned with respect to the common axis and are typically movable with respect to each other about the common axis to produce varying degrees of imbalance during rotation of the weights. As the one or more weights inside the first compacting drum 118 rotates, the off-center or eccentric positions of the weights induce oscillatory or vibrational forces to the first compacting drum 118, which in turn are imparted to the work area 103 being compacted.

The amplitude of the vibrations produced by such an arrangement of eccentric rotating weights may be varied by changing the positioning of the eccentric weights with respect to each other about their common axis. This varies the average distribution of mass, that is, the centroid, with respect to the common axis of the weights. It may be contemplated that the amplitude in such an arrangement increases as the centroid moves away from the common axis of the weights and decreases toward zero as the centroid moves toward the common axis. Further, varying the rotational speed of the weights about their common axis may change the frequency of the vibrations produced by such an arrangement of rotating eccentric weights. In some examples, the eccentrically positioned weights are arranged to rotate inside the first compacting drum 118 independent of the rotation of the first compacting drum 118 so as to have more control over changing the amplitude and/or frequency of the vibration of the first compacting drum 118 during the compaction operation.

The amplitude and frequency of vibration along with the rotational speed of the compacting drums 118, 120 are typically controlled to vary the degree of compaction. By altering the distance of the eccentric weights from the common axis in the variable vibratory mechanism 126, the amplitude portion of the compaction effort is modified. By altering the speed of rotation of the eccentric weights inside the first compacting drum 118, the frequency portion of the compaction effort is modified. By altering the rotational speed of the compacting drums 118, 120 about their common axis, the frequency portion of the compaction effort is modified. Additionally, both the amplitude portion and the frequency portion of the compaction effort of the variable vibratory mechanism 126 may be modified by changing the distance of the eccentric weights, the speed of rotation of the eccentric weight, and the rotational speed of the compacting drums 118, 120, at the same time. It may be contemplated that the arrangement of eccentric weights described is merely exemplary and the present disclosure is not intended to be limited to such arrangements. In some examples, other types of variable vibratory mechanism that modifies the compaction effort of the compactor 101 may be employed without departing from the scope of the present disclosure.

Further, it may be understood that the compactor 101 may include fewer or additional components designed to compact the paving material 105, and still achieve the desired compaction effort over the work area 103. For example, the compactor 101 may include only one compacting element, such as only the first compacting drum 118 and includes wheels in place of the second compacting drum 120. Furthermore, the compacting drums 118, 120 may include various surface configurations to facilitate compaction of the paving material 105, such as the surface of the compacting drums 118, 120 may be generally smooth and/or include a studded surface.

In an embodiment of the present disclosure, the compactor 101 may further include a first compaction sensor 134 and a second compaction sensor 136. For example, the first compaction sensor 134 may be positioned on the forward end 104 of the frame 108, while the second compaction sensor 136 may be positioned on the rearward end 106 of the frame 108 of the compactor 101. The first compaction sensor 134 may be configured to sense a first compaction data 'C1' corresponding to a density of the work area 103, such as density 'D1' of the paving material 105, lying ahead of the compactor 101 on which the compaction operation is to be performed. Further, the second compaction sensor 136 may be configured to sense a second compaction data 'C2' corresponding to a density 'D2' of a compacted portion 103' (hereinafter referred to as compacted first portion 103') of the work area, such as that lying in the rear of the compactor 101 on which the compaction operation has been performed. Each of the first compaction sensor 134 and the second compaction sensor 136 may be of a type known in the art, and include one or more of acceleration sensors, ground penetrating radar sensors, sonic sensors, gage wheels, nuclear density sensors, vibratory sensors, and the like. Alternatively, the compaction sensors 134, 136 may use indirect technologies, for example, machine power usage indicators, temperature indicators, motion resistance indicators, or any combination of these technologies for the purpose.

As illustrated in FIG. 1, the compactor 101 may further include a controller 132 for controlling the compaction operation over the work area 103 at the worksite 102. In one embodiment of the present disclosure, the controller 132 may be positioned on-board in the compactor 101 and may be configured to communicate with an on-board machine electronic control module (ECM) of the compactor 101. In other embodiments, the controller 132 may be located remotely with respect to the compactor 101, as a part of the system 100. In an embodiment of the present disclosure, the controller 132 is operatively coupled to the first compaction sensor 134, the second compaction sensor 136, the first motor 122, the second motor 124, the first vibratory mechanism 128, and the second vibratory mechanism 130 and configured to control the compacting effort generated by the compactor 101 based on the first compaction data 'C1' and the second compaction data 'C2'. The detailed working of the controller 132 will now be described in the following description in conjunction with FIGS. 2 through 3.

Figure 2:
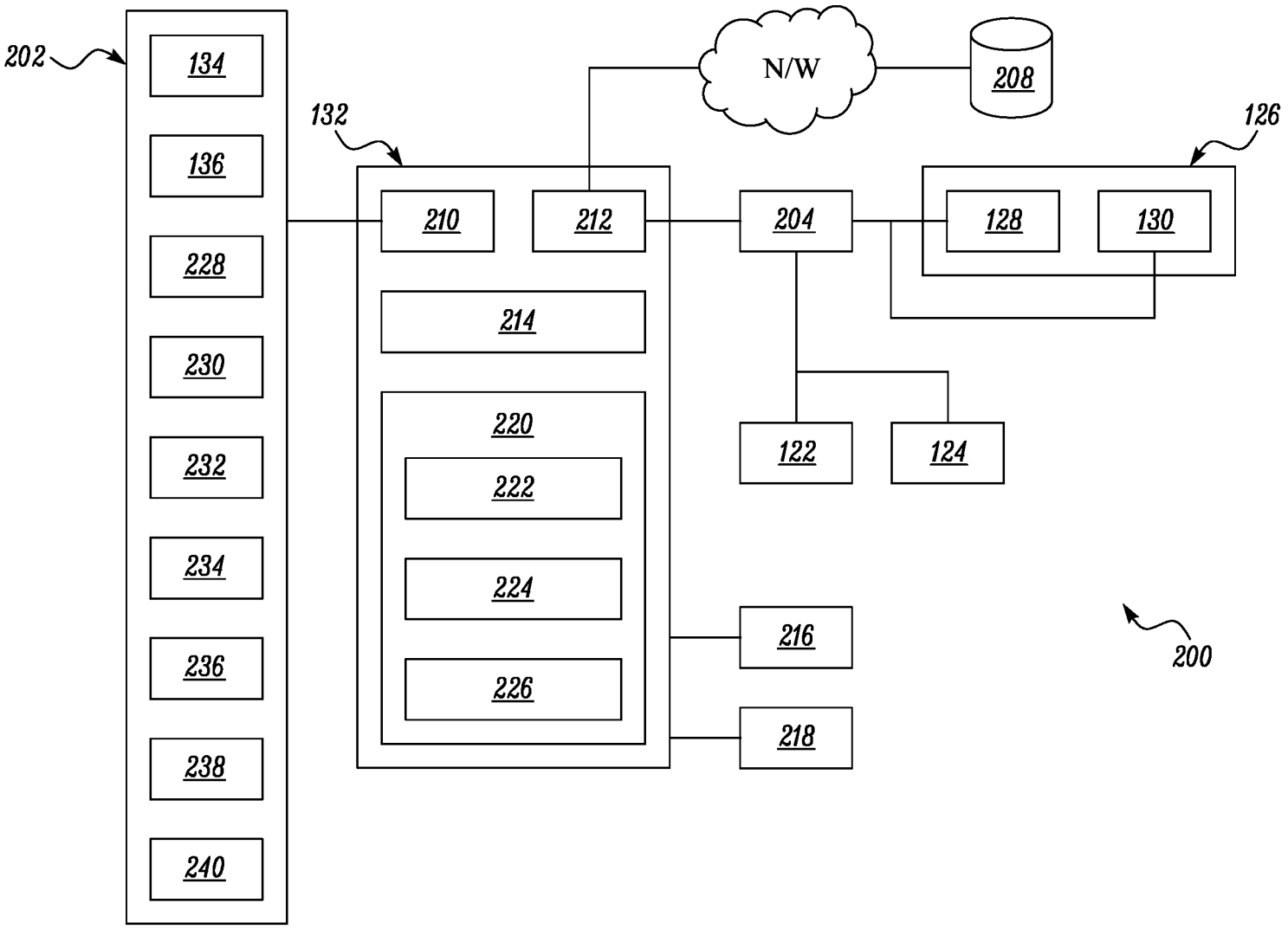
FIG. 2 illustrates a schematic view of an exemplary control system for operating the compactor at the worksite, in accordance with an embodiment of the present disclosure.

Referring to FIG. 2, details of an exemplary control system 200 for operating the compactor 101 at the worksite 102 are illustrated. In an exemplary embodiment, the control system 200 includes the controller 132 and a plurality of on-board sensors 202, the machine ECM 204, the variable vibratory mechanism 126, the first motor 122, the second motor 124, a memory 216, an I/O unit 218, and a database 208 operatively coupled to the controller 132.

The controller 132 may include one or more microprocessors, microcomputers, microcontrollers, programmable logic controller, DSPs (digital signal processors), central processing units, state machines, logic circuitry, or any other device or devices that process/manipulate information or signals based on operational or programming instructions. The controller 132 may be implemented using one or more controller technologies, such as Application Specific Integrated Circuit (ASIC), Reduced Instruction Set Computing (RISC) technology, Complex Instruction Set Computing (CISC) technology, etc. The memory 216 may include a random access memory (RAM) and read only memory (ROM). The RAM may be implemented by Synchronous Dynamic Random Access Memory (SDRAM), Dynamic Random Access Memory (DRAM), and/or any other type of random access memory device. The ROM may be implemented by a hard drive, flash memory and/or any other desired type of memory device.

The plurality of on-board sensors 202 may be disposed on the compactor 101 and configured to sense one or more parameters associated with the compactor 101 as well as the work area 103 to be compacted by the compactor 101 and the compacted first portion 103' of the work area. For example, the on-board sensors 202 may include the first compaction sensor 134, a first temperature sensor 228, and a first location sensor 238 positioned on the forward end 104 of the frame 108 of the compactor 101 and the second compaction sensor 136, a second temperature sensor 230, and a second location sensor 240 positioned on the rearward end 106 of the frame 108 of the compactor 101. The first temperature sensor 228 and the second temperature sensor 230 may be configured to sense temperature data and generate a first temperature data and a second temperature data associated with the work area 103 and the compacted first portion 103', respectively. For example, the first temperature sensor 228 and the second temperature sensor 230 may be one of a thermal imager or any appropriate contact type of temperature sensor. Further, the first location sensors 238 and the second location sensor 240 may be configured to sense location data, and generate a first location data 'T1' and a second location data 'T2' associated with the forward end 104 and the rearward end 106 of the compactor 101 respectively. For example, the first location sensors 238 and the second location sensor 240 may include one or more of a Global Positioning System (GPS), a Global Navigation Satellite System (GNSS), or any other location tracking system known in the art.

The on-board sensors 202 further include a machine speed sensor 232 and a compaction measurement value (CMV) sensor 234 positioned on one or both of the compacting drums 118, 120 of the compactor 101. The machine speed sensor 232 may be configured to sense the rotational speed of the compacting drums 118, 120 and generate a machine speed data 'V'. In some examples, the machine speed sensor 232 may include a magnetic pickup or optical sensor. The CMV sensor 234 may be configured to sense acceleration signals that represent rebound force from the work area 103 to the compacting drums 118, 120 and generate a CMV data 'CMV'. The CMV sensor 234 may include any accelerometer-based measurement system. The on-board sensors 202 further include a machine drive power sensor 236 configured to sense a rolling resistance experienced by the compactor 101 to propel on the paving material 105 layered on the work area 103 and generate a rolling resistance data 'R' associated with the compactor 101. The sensors 134, 136, 228, 230, 232, 234, 236, 238, and 240 are well known in the art and hence, not described in greater detail for the sake of brevity of the disclosure.

The machine ECM 204 may be an on-board control module operatively coupled to and configured to control the components of the compactor 101, such as the variable vibratory mechanism 126 and the motors 122, 124. The machine ECM 204 may be configured to control the operations of the variable vibratory mechanism 126 (including first vibratory mechanism 128 and the second vibratory mechanism 130) and the motors 122, 124 in response to the inputs received from the controller 132. The machine ECM 204 is well known in the art and hence, not described in greater detail for the sake of brevity of the disclosure. Further, although the controller 132 and the machine ECM 204 are shown and described to be separate components, it may be contemplated by a person skilled in the art that the two may be combined such that the controller 132 is implemented within the machine ECM 204.

In an embodiment of the present disclosure, the controller 132 may include a sensing module 210, a communication module 212, a processing module 214, and a machine learning module 220. In an embodiment of the present disclosure, the controller 132 is configured to receive the first compaction data 'C1', such as the density 'D1', associated with the work area 103, lying ahead of the compactor 101, from the first compaction sensor 134 positioned on the forward end 104 of the compactor 101. For example, the sensing module 210 may be configured to receive the first compaction data 'C1' associated with the work area 103 that needs to be compacted by the compactor 101, from the first compaction sensor 134.

In some alternative embodiments, the controller 132 may be configured to receive the first temperature data 'T1', associated with the work area 103, from the first temperature sensor 228. For example, the sensing module 210 may be configured to receive the first temperature data 'T1' corresponding to the temperature of the paving material 105 on the work area 103, lying in the front of the compactor 101 on which the compaction operation is to be performed, from the first temperature sensor 228

In some embodiments, the sensing module 210 of the controller 132 may also be configured to receive the machine speed data 'V', the CMV data 'CMV', the rolling resistance data 'R' associated with the compactor 101, from the machine speed sensor 232, the CMV sensor 234, and the machine drive power sensor 236, respectively. In some embodiments, the machine ECM 204 may be configured to determine the rotational speed of the compacting drums 118, 120 and communicate the machine speed data 'V' to the sensing module 210. As known in the art, the CMV data 'CMV' may represent a bearing capacity of the work area 103 that is being compacted. The rolling resistance 'R' may represent the resistance experienced by the compactor 101 to propel on the paving material 105 layered on the work area 103. It may be contemplated that the sensing module 210 may utilize any known wired or wireless communication channels, such as Local Area Network (LAN), Ethernet, Wi-Fi, Bluetooth, infrared, or any combination thereof to collect the data from the on-board sensors 202.

The controller 132 may be further configured to receive data related to a type of paving material 105, lying ahead of the compactor 101 on which the compaction operation is to be performed. The paving material 105 may be soil, sand, gravel, loose bedrock, asphalt, recycled concrete, bituminous mixtures, or any other compactable material. The controller 132 may be configured to receive the data related to the type of paving material 105 from the operator via the I/O unit 218 provided in the operator console 112. Alternatively, the controller 132 may be configured to receive the data related to the type of paving material 105 from the database 208, via the communication module 212.

The controller 132 may be further configured to determine a first compaction effort based on the first compaction data 'C1'. The first compaction effort corresponds to an amplitude value for the vibratory mechanisms 128, 130, a frequency value for the vibratory mechanisms 128, 130, and a speed value of the compacting drums 118, 120 of the compactor 101. For example, the processing module 214 may be configured to determine the amplitude value for the vibratory mechanisms 128, 130, the frequency value for the vibratory mechanisms 128, 130, and a speed value of the compacting drums 118, 120 corresponding to the first compaction effort at this stage. In accordance with some embodiments of the present disclosure, the processing module 214 may be configured to determine the first compaction effort based on the first compaction data 'C1' as well as the inputs received from the operator via the I/O unit 218 provided in the operator console 112. For instance, the processing module 214 of the compactor 101 may be configured to receive a predefined target compaction data (i.e., a target density $D_T$) associated with the work area 103 that is required to be achieved after the compaction operation by the compactor 101. The predefined target compaction data may be received from the operator via the I/O unit 218. Alternatively, the processing module 214 may extract the target compaction data '$D_T$' from the database 208. The processing module 214 is configured to determine the first compaction effort based on the first compaction data 'C1' and the predefined target compaction data '$D_T$'.

In some embodiments, the processing module 214 may be further configured to modify the first compaction effort based additionally on one or more of the first temperature data 'T1', the machine speed data 'V', the CMV data 'CMV', the rolling resistance data 'R', and the type of paving material 105. In an exemplary embodiment, different amplitude value, frequency value, and/or speed value would be used depending on the first temperature data 'T1', the machine speed data 'V', the CMV data 'CMV', the rolling resistance data 'R', and the type of paving material 105. In one example, if the processing module 214 determines that the first temperature data 'T1' suggests that the paving material 105 is "hot", the processing module 214 may be configured to modify the first compaction effort to a higher value. However, if the processing module 214 determines that the first temperature data 'T1' suggests that the paving material 105 is "cold", the processing module 214 may be configured to modify the first compaction effort to a lower value. For example, a warm asphalt will compact better at higher amplitudes than cold asphalt, the processing module 214 in such cases may be configured to increase the amplitude value of the variable vibratory mechanism 126.

Similarly, if the CMV data 'CMV' suggests that the paving material 105 is already substantially compacted; then the processing module 214 may be configured to modify the first compaction effort to a lower value. Furthermore, if a value of the rolling resistance data 'R' is low, the processing module 214 may determine that the paving material 105 is already substantially compacted and modify the first compaction effort to a lower value. Further, if the speed data 'V' suggests that the compactor 101 is operating at a high speed, the processing module 214 may be configured to modify the first compaction effort to a higher value. Furthermore, the processing module 214 may be configured to modify the first compaction effort to increase the frequency of the vibration in response to increase in machine speed to maintain a desired compaction effort per unit distance covered by the compactor 101. For example, in case of asphalt, the processing module 214 may be configured to maintain the compaction effort at one vibration per inch of machine travel, and thus, as the machine speed increases, the processing module 214 may accordingly increase the frequency of vibration to maintain the required compaction effort.

Further, the controller 132 is configured to control the variable vibratory mechanism 126 of the compactor 101 to perform compaction on the work area 103 with the determined first compaction effort. For example, the processing module 214 may be configured to obtain the compacted first portion 103' of the work area by controlling the compactor 101 to perform compaction on the work area 103 with the determined first compaction effort. For example, the processing module 214 is configured to modify one or more of the amplitude of the vibratory mechanisms 128, 130, the frequency of the vibratory mechanisms 128, 130, and the speed of rotation of the compacting drums 118, 120 to match the amplitude value, the frequency value, and the speed value, respectively, corresponding to the determined first compaction effort. In an embodiment, the processing module 214 may transmit, via the communication module 212, the determined first compaction effort (i.e. the amplitude value, the frequency value, and the speed value) to the machine ECM 204, which in turn modifies the one or more of the amplitude of the vibratory mechanisms 128, 130, the frequency of the vibratory mechanisms 128, 130, and the speed of rotation of the compacting drums 118, 120 to match the amplitude value, the frequency value, and the speed value, respectively, corresponding to the determined first compaction effort. For this purpose, the machine ECM 204 may be configured to modify the amplitude of the vibratory mechanisms 128, 130 by adjusting the position of the eccentric weights disposed inside the compacting drums 118, 120 by controlling the respective motors of the vibratory mechanisms 128, 130. Similarly, the machine ECM 204 may be configured to modify the frequency of the vibratory mechanisms 128, 130 by varying the rotational speed of the eccentric weights disposed inside the compacting drums 118, 120 by controlling the respective motors of the vibratory mechanisms 128, 130. The machine ECM 204 may be further configured to modify the speed of rotation of the compacting drums 118, 120 by controlling the first and second motors 122, 124.

The processing module 214 of the controller 132 may be further configured to receive the second compaction data 'C2' associated with the resultant compacted first portion 103' from the second compaction sensor 136 positioned on the rearward end 106 of the compactor 101. In accordance with the embodiments of the present disclosure, the second compaction data 'C2' corresponds to the density 'D2' of the compacted first portion 103' of the work area.

In some embodiments, the controller 132 may be configured to receive the second temperature data 'T2', associated with the compacted first portion 103' of the work area, from the second temperature sensor 230. For example, the sensing module 210 may be configured to receive the second temperature data 'T2' corresponding to temperature of the compacted first portion 103' of the work area, on which the compaction operation has been performed, from the second temperature sensor 230.

The controller 132 may further be configured to determine a variance between the first compaction data 'C1' and the second compaction data 'C2' before and after the compaction is performed by the compactor 101.

In an embodiment, the processing module 214 may be configured to determine a change in the density of the work area 103 and the compacted first portion 103' of the work area. For instance, once the compaction operation has been performed by the compactor 101 on the compacted first portion 103' of the work area, the density 'D2' of the compacted first portion 103' of the work area will be greater than the density 'D1' of the work area 103 before the compaction operation. Thus, the processing module 214 may be configured to determine a change 'ΔD' in the density from D1 to D2, achieved from the compaction operation.

Furthermore, the controller 132 may be configured to determine a correlation between the determined variance and the first compaction effort. For example, the processing module 214 of the controller 132 may be configured to identify a relation between the change in the density 'ΔD' of the work area 103 achieved from the compaction operation and the first compaction effort that is applied to achieve the change 'ΔD'. The determined correlation may be an equation that indicates how the density of work area 103 changes with respect to a particular compaction effort value, including the amplitude value and frequency value of the variable vibratory mechanism 126 and the machine speed of the compactor 101. In some embodiments, the first temperature data 'T1', the second temperature data 'T2', the machine speed data 'V', the CMV data 'CMV', the rolling resistance data 'R', and the type of paving material 105 may also be considered by the processing module 214 in determining the correlation between the determined variance and the first compaction effort.

In some embodiments, the controller 132 may be configured to obtain data related to the first compaction data, the second compaction data, the variance, and the correlation associated with its location (i.e. the work area 103) from other compactors 101 in the work site 102 or the database 208 via the communication module 212. In such cases, the controller 132 may be configured to update the correlation determined by the processing module 214 based on the obtained data. In accordance with an embodiment, the correlation may be determined/updated by the machine learning module 220 using machine learning algorithms, which will be described in greater detail in the later part of the description. Alternatively, the controller 132 may be configured to utilize the obtained correlation for further processing.

The controller 132 may be further configured to determine a second compaction effort for the work area 103 based on the target compaction data (i.e., the target density $D_T$) associated with the work area 103 and the determined correlation. The second compaction effort corresponds to an amplitude value for the vibratory mechanisms 128, 130, a frequency value for the vibratory mechanisms 128, 130, and a speed value of the compacting drums 118, 120 of the compactor 101. For example, the processing module 214 may be configured to determine the amplitude value for the vibratory mechanisms 128, 130, the frequency value for the vibratory mechanisms 128, 130, and a speed value of the compacting drums 118, 120 corresponding to the second compaction effort at this stage. In accordance with the embodiments of the present disclosure, the second compaction effort may be used for performing a subsequent compaction pass on the compacted first portion 103' or perform a first compaction pass on any new portion of the work area 103 that has not been compacted at all by the compactor 101.

In some embodiments, the processing module 214 may be further configured to modify the second compaction effort based additionally on one or more of the first temperature data 'T1', the second temperature data 'T2', the speed data 'V', the CMV data 'CMV', the rolling resistance data 'R' and the type of paving material 105. In an embodiment, the processing module 214 may be configured to determine a change 'ΔT' from T1 to T2 to calculate how quickly the paving material 105 is cooling, which can be influenced by the weather conditions, and accordingly modify the second compaction effort.

The controller 132 may be further configured to control the variable vibratory mechanism 126 of the compactor 101 to perform compaction on the work area 103 with the determined second compaction effort. For example, the processing module 214 may be configured to modify one or more of the amplitude of the vibratory mechanisms 128, 130, the frequency of the vibratory mechanisms 128, 130, and the speed of rotation of the compacting drums 118, 120 to match the amplitude value, the frequency value, and the speed value, respectively, corresponding to the determined second compaction effort. In an embodiment, the processing module 214 may transmit, via the communication module 212, the second compaction effort (i.e. the amplitude value, the frequency value, and the speed value) to the machine ECM 204, which in turn modifies the one or more of the amplitude of the vibratory mechanisms 128, 130, the frequency of the vibratory mechanisms 128, 130, and the speed of rotation of the compacting drums 118, 120 to match the amplitude value, the frequency value, and the speed value, respectively, corresponding to the determined second compaction effort.

Although the description is provided in respect of compactor 101 travelling in direction T and the sensor 134 and the sensor 136 acting as first and second compaction sensors, respectively, it may be contemplated that when the direction of the travel of the compactor 101 changes to an opposite direction (for e.g., to T' when the compactor 101 moves in reverse mode), the roles of the first and second compaction sensors 134, 136 also interchange. In such cases, the second compaction sensor 136 will be configured to sense the first compaction data 'C1' corresponding to the density of the work area 103 lying ahead of the compactor 101 on which the compaction operation is to be performed. Similarly, the first compaction sensor 134 will be configured to sense the second compaction data 'C2' corresponding to the density 'D2' of the compacted first portion 103' of the work area, such as that lying in the rear of the compactor 101 on which the compaction operation has been performed. In either case, the compactor 101 is configured to determine the density of the work area 103 lying ahead of the compactor 101 and modify its compaction efforts based on the density of the compacted work area 103' lying in the rear of the compactor 101.

The processing module 214 of the controller 132 may be further configured to receive a compaction data associated with the resultant compacted portion achieved after the second compaction effort from the second compaction sensor 136, and determine a variance between a density of the resultant compacted portion achieved after the second compaction effort and a density of the same portion before the second compaction effort. The processing module 214 may be further configured to update the correlation based on the determined variance and the second compaction effort.

In accordance with an embodiment, the correlation may be determined and updated by the machine learning module 220 using machine learning algorithms. The machine learning module 220 is configured to execute the instruction stored in the memory 216, to perform one or more predetermined operations. The machine learning module 220 may include an observation module 222, a learning module 224, and the decision module 226 to perform the one or more predetermined operations. The machine learning module 220 may be a data processor and/or a mainframe employing artificial intelligence (AI) to perform the one or more predetermined operations, in accordance with the embodiments of the present disclosure. In some embodiments, the machine learning module 220 may be incorporated in the controller 132 as shown, and may be configured as constituting element separate from the controller 132. In some embodiments, the machine learning module 220 may be a specially constructed computing platform for carrying out the predetermined operations as described herein. The machine learning module 220 may be implemented or provided with a wide variety of components or systems (not shown), including one or more of memories, registers, and/or other data processing devices and subsystems.

The machine learning module 220 may be any system configured to learn and adapt itself to do better in changing environments. The machine learning module 220 may employ any one or combination of the following computational techniques: neural network, constraint program, fuzzy logic, classification, conventional artificial intelligence, symbolic manipulation, fuzzy set theory, evolutionary computation, cybernetics, data mining, approximate reasoning, derivative-free optimization, decision trees, and/or soft computing.

The machine learning module 220 may implement an iterative learning process. The learning may be based on a wide variety of learning rules or training algorithms. The learning rules may include one or more of back-propagation, patter-by-pattern learning, supervised learning, and/or interpolation. As a result of the learning, the machine learning module 220 may learn to identify correlations between a change in the density of work area and a corresponding compaction effort.

The observation module 222 of the machine learning module 220 may be configured to obtain a plurality of first compaction data, second compaction data, variances between the respective first compaction data and second compaction data, the first compaction effort, and the second compaction effort associated with one or more portions of the work area 103, and provide it to the learning module 224. The learning module 224 may be configured to learn by correlating the variances with the respective compaction efforts. Based on the results of the learning of the learning module 224, the decision module 226 may be configured to determine a correlation between a variance and a compaction effort. As discussed above, the correlation may be an equation that indicates how the density of work area 103 changes with respect to a particular compaction effort value, including the amplitude value and frequency value of the variable vibratory mechanism 126 and the machine speed of the compactor 101. In some embodiments, when there are a plurality of correlations previously learnt by the learning module 224 based on previously received data, the decision module 226 may be configured to update the determined correlation based on the plurality of correlations previously learnt by the learning module 224. In accordance with various embodiments of the present disclosure, the decision module 226 may be configured to continuously update the correlation, based on data observed by the observation module 222, until a correlation confidence score of the correlation is greater than a predetermined threshold value.

Additionally, in some embodiments, the observation module 222 may be configured to obtain the first temperature data, the second temperature data, the machine speed data, the CMV data, the rolling resistance data, and the type of paving material 105 associated with the one or more portions of the work area 103. The learning module 224 may be configured to learn by additionally correlating the other obtained data (such as the first temperature data, the second temperature data, the machine speed data, the CMV data, the rolling resistance data, and the type of paving material 105) with the respective compaction efforts. Based on the results of the learning of the learning module 224, the decision module 226 may be configured to determine the correlation for different temperature data, machine speed data, CMV data, rolling resistance data, and types of the paving material 105 based on the results.

In some embodiments, the controller 132 may be further configured to display the compaction related information and receive inputs from the operator via the I/O unit 218. For example, the I/O unit 218 may be configured to display the data corresponding to the compaction efforts and notify the operator of the compactor 101 about the amplitude value, the frequency value, and the speed value in numerical or some other forms, corresponding to each of the compaction efforts. Further, the I/O unit 218 may be configured to receive an input from an operator of the compactor 101 to accept or modify the displayed compaction effort.

In a further embodiment of the present disclosure, the controller 132 may be configured to store the plurality of first compaction data along with the respective first location data, the plurality of second compaction data along with the respective second location data, the determined variances and the determined correlation, associated with one or more work areas 103, in the database 208. The controller 132 may be configured to associate the first location data with the first compaction data, and the second location data with the second compaction data for storage in the database 208. It may be contemplated that for at least certain compaction operations, two or more compactors 101 may be working simultaneously and/or in coordination with one another to complete the compaction operation over the work area 103 and/or the worksite 102. In such a system, the other compactors 101 may extract such stored compaction and correlation information from the database 208 and operate accordingly. Since each data is tagged with an associated location data, the other compactors 101 may easily identify and extract the stored compaction and correlation information corresponding to its location from the database 208. The stored compaction information corresponding to the location of the compactor 101 may assist the other compactor 101 to obtain the compaction data. Similarly, the other compactor 101 may learn from the correlations determined by the compactor 101 and accordingly determine/modify its compaction effort to a more accurate value. Alternatively, the communication module 212 may be configured to communicate each of the plurality of first compaction data along with the respective first location data, the plurality of second compaction data along with the respective second location data, the determined variances and the determined correlation to the other machines in proximity of the work area 103 over a wireless communication channel or network (not shown).

INDUSTRIAL APPLICABILITY

Figure 3:
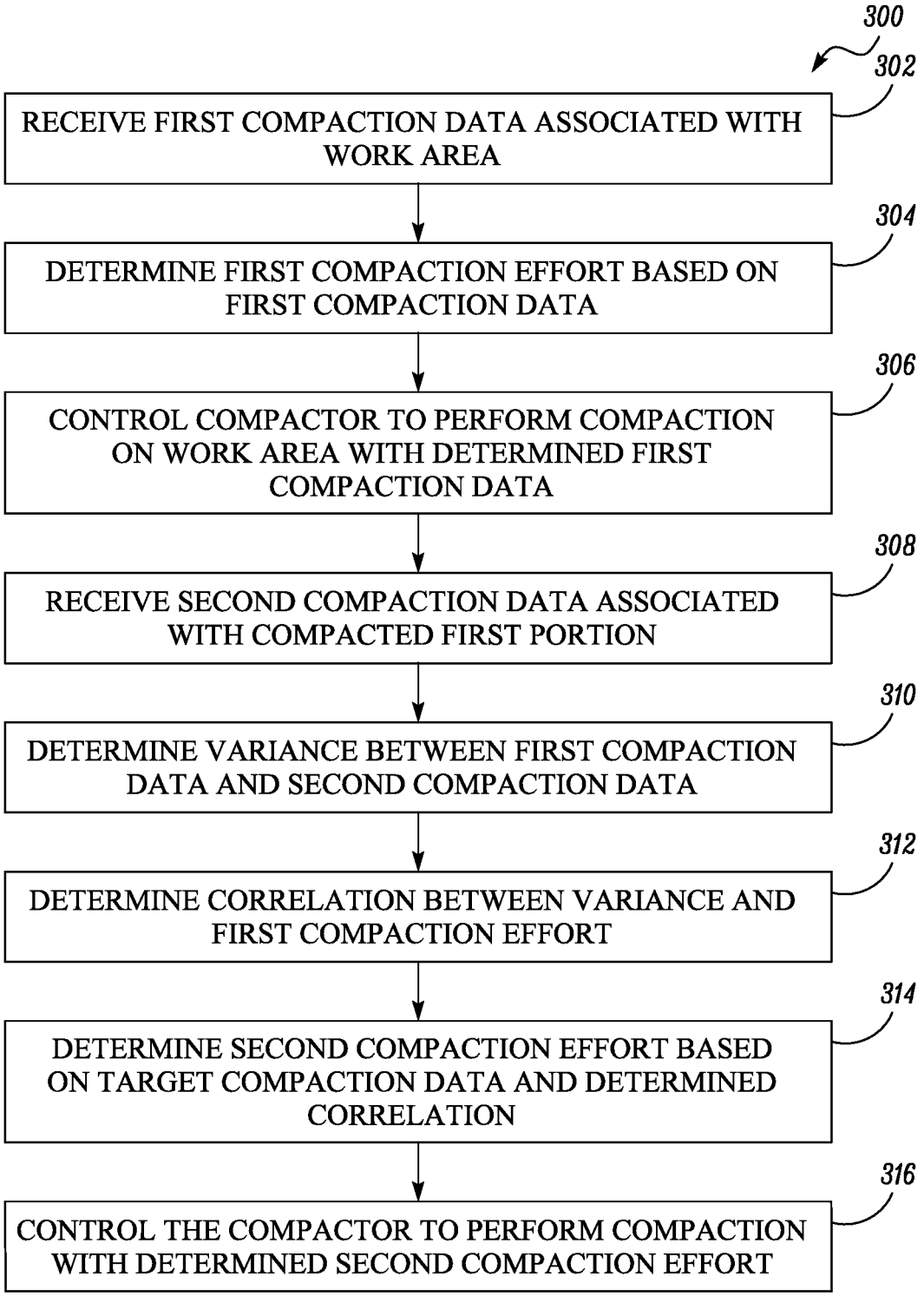
FIG. 3 illustrates a flow chart of an exemplary method for operating the compactor at the worksite, in accordance with an embodiment of the present disclosure.

FIG. 3 illustrates an exemplary flow chart of a method 300 for operating the compactor 101 at the worksite 102. The method 300 begins at step 302 with the controller 132 receiving the first compaction data associated with the work area 103 from the first compaction sensor 134 positioned on the forward end 104 of the compactor 101. As described above, the first compaction data corresponds to the density of the work area 103, such as the density 'D1' of the paving material 105, lying in the front of the compactor 101 on which the compaction operation is to be performed. In some embodiments, the controller 132 additionally determines the machine speed data 'V', the CMV data 'CMV', the rolling resistance data and the type of paving material 105 at this stage.

At step 304, the controller 132 determines the first compaction effort based on the received first compaction data and a target compaction data to be achieved for the work area 103 after compaction. For instance, the controller 132 determines the amplitude value for the first vibratory mechanism 128 and the second vibratory mechanism 130, the frequency value for the first vibratory mechanism 128 and the second vibratory mechanism 130, and a speed value of the compacting drums 118, 120 of the compactor 101 corresponding to the first compaction effort at this stage. In accordance with some embodiments of the present disclosure, the controller 132 may receive the first compaction effort (i.e. the amplitude value, the frequency value, and the speed value) from the operator via the I/O unit 218. In other embodiments, the controller 132 may determine the first compaction effort based on the first compaction data 'C1', the target compaction data, as well as the inputs received from the operator via the I/O unit 218. In some embodiments, the controller 132 modifies the first compaction effort based additionally on one or more of the first temperature data 'T1', the machine speed data 'V', the Compaction Measurement Value 'CMV' data, the rolling resistance data 'R' and the type of paving material 105.

At step 306, the controller 132 controls the compactor 101 to perform compaction on the work area 103 with the determined first compaction effort, to obtain a compacted first portion 103' of the work area. For example, the controller 132 transmits the first compaction effort (i.e. the amplitude value, the frequency value, and the speed value) to the machine ECM 204, which in turn modifies the one or more of the amplitude of the vibratory mechanisms 128, 130, the frequency of the vibratory mechanisms 128, 130, and the speed of rotation of the compacting drums 118, 120 to match the amplitude value, the frequency value, and the speed value, respectively, corresponding to the determined first compaction effort.

At step 308, the controller 132 receives the second compaction data 'C2' associated with the resultant compacted first portion 103' from the second compaction sensor 136 positioned on the rearward end 106 of the compactor 101. As described above, the second compaction data corresponds to the density 'D2' of the compacted first portion 103' of the work area. Further, the controller 132, at step 310, determines the variance ΔD between the first compaction data 'C1' and the second compaction data 'C2', in response to the applied first compaction effort.

At step 312, the controller 132 determines the correlation between the determined variance and the first compaction effort. In an embodiment, the controller 132 obtains the determined variance, the first compaction data 'C1', the second compaction data 'C2', and the first compaction effort, and learns by correlating the determined variance ΔD with the first compaction effort. Based on the learning results, the controller 132 determines the correlation between the variance and the first compaction effort.

At step 314, the controller 132 determines a second compaction effort for the work area 103 based on the target compaction data (i.e., the target density $D_T$) associated with the work area 103 and the determined correlation. The controller 132 determines the amplitude value for the vibratory mechanisms 128, 130, the frequency value for the vibratory mechanisms 128, 130, and a speed value of the compacting drums 118, 120 corresponding to the second compaction effort at this stage. In accordance with the embodiments of the present disclosure, the second compaction effort may be used for performing a subsequent compaction pass to be performed on the compacted first portion 103' or a first compaction pass on any new portion of the work area 103 by the compactor 101. In some embodiments, the controller 132 modifies the second compaction effort based additionally on one or more of the first temperature data 'T1', the second temperature data 'T2', the speed data 'V', the CMV data 'CMV', the rolling resistance data 'R', and the type of paving material 105.

At step 316, the controller 132 controls the compactor 101 to perform compaction on the work area 103 with the determined second compaction effort. For instance, the controller 132 transmits the second compaction effort (i.e. the amplitude value, the frequency value, and the speed value) to the machine ECM 204, which in turn modifies the one or more of the amplitude of the vibratory mechanisms 128, 130, the frequency of the vibratory mechanisms 128, 130, and the speed of rotation of the compacting drums 118, 120 to match the amplitude value, the frequency value, and the speed value, respectively, corresponding to the determined second compaction effort.

The present disclosure finds potential application in, among other potential applications, any compaction operation which involves a compaction machine having a variable vibratory mechanism to provide a compaction effort. In particular, the present disclosure assists in maximizing the compaction effort so that the desired level of compaction is achieved in minimum number of passes. The present disclosure employs a closed loop mechanism of taking feedback related to change in the density of work area after every pass and improving the compaction effort based on the feedback. The present disclosure achieves this by identifying a correlation between (i) the change in density of the work area before and after compaction operation and (ii) the compaction effort applied to obtain the change, and thereby using the correlation to automatically determine the compaction efforts for the next stages or subsequent passes.

Moreover, the present disclosure assists in automating the compaction operation and leads to reduced labor costs and helping the contractors reduce potentially costly errors in the compaction operation. Using this system, the operations of the compactor 101 (such as determining the compaction efforts, controlling the compactor settings) can be automated and the compactors can be operated in semi-autonomous, remote or fully-autonomous mode. Furthermore, the present disclosure allows the compactor 101 to learn from the correlations determined by other compactors 101 in the work site 102 and update the correlation. The updated correlation can then be shared with other compactors 101 directly or through database 208 to increase the overall efficiency of the system.

Conventionally, the compaction efforts for a work area 103 are determined based on the inputs received from the operators. However, there is always a potential for human errors when the determination of the compaction efforts is done manually by the operator(s) merely based on their experience and trainings. Errors, such as using a higher compaction effort than prescribed could result in crushing of the paving material, or a lower compaction effort than prescribed could lead to requiring more number of passes, and thus makes the overall job to be inefficient and inconsistent in quality.

The present disclosure allows proactively altering the compaction effort of the compactor 101 for the work area 103, based on the determined correlation indicates how the density of work area 103 changes with respect to a particular compaction effort value, thereby minimizing human intervention.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A system for compacting material in a work area, the system comprising:

a compactor for providing a compaction effort to the material in the work area, the compactor including a variable vibratory mechanism and a compacting drum, the compaction effort corresponding to an amplitude of the variable vibratory mechanism, a frequency of the vibratory mechanism and a seed of rotation of the compacting drum;

a first compaction sensor positioned on a forward end of the compactor;

a second compaction sensor positioned on a rearward end of the compactor;

a compaction measurement value (CMV) sensor configured to generate CMV data corresponding to a rebound force from the work area to the compacting drum; and a controller operatively coupled to the first and the second compaction sensors, and the compactor, the controller being configured to:

receive a first compaction data associated with the work area from the first compaction sensor;

determine a first compaction effort based on the first compaction data and a predefined target density of the material after compacting by the compactor;

modify the determined first compaction effort based on the CMV data;

control the compactor to compact the material in the work area with the modified first compaction effort to obtain a compacted first portion of the work area;

receive a second compaction data associated with the compacted first portion from the second compaction sensor;

determine a variance between the first compaction data and the second compaction data;

determine a correlation between the determined variance and the modified first compaction effort, the correlation corresponding to an equation indicating how the density of the material in the work area changes with respect to application of the modified first compaction effort by the compactor;

determine a second compaction effort based on the predefined target density and the determined correlation;

modify the determined second compaction effort based on the CMV data; and control the compactor to compact the material in the work area with the modified second compaction effort.

2. The system of claim 1, wherein the first compaction data corresponds to a density of the work area and the second compaction data corresponds to a density of the compacted first portion of the work area.

3. The system of claim 1, wherein each of the first compaction sensor and the second compaction sensor includes one of a ground penetrating radar sensor, an acceleration sensor, a sonic sensor, a vibratory sensor, or a nuclear density sensor.

4. The system of claim 1, wherein the controller is further configured to receive the target compaction data associated with the work area and wherein the first compaction effort is further based on the received target compaction data.

5. The system of claim 1 further comprising:

a first temperature sensor, positioned on the forward end of the compactor, to generate a first temperature data; and a second temperature sensor, positioned on the rearward end of the compactor, to generate a second temperature data, and wherein the controller is operatively coupled to each of the first temperature sensor and the second temperature sensor, and wherein the controller is further configured to:

modify each of the first compaction effort and the second compaction effort based on the first temperature data and the second temperature data.

6. The system of claim 1 further comprising:

a machine drive power sensor configured to generate rolling resistance data associated with the compactor, and wherein the controller is operatively coupled to the machine drive power sensor and configured to modify the first compaction effort and the second compaction effort based on the rolling resistance data.

7. The system of claim 1, wherein the variable vibratory mechanism is configured to provide the modified first compaction effort and the modified second compaction effort.

8. The system of claim 7, wherein the controller is further configured to:

modify one or more of an amplitude of the variable vibratory mechanism, a frequency of the variable vibratory mechanism, and a speed of the compactor to match the amplitude value, the frequency value, and the speed value, respectively, corresponding to the modified first compaction effort and the modified second compaction effort.

9. The system of claim 1, wherein the controller further includes:

an observation module for obtaining a plurality of first compaction data, second compaction data, variances between the respective first compaction data and second compaction data, the first compaction effort, and the second compaction effort;

a learning module for learning by correlating the variances with the respective compaction efforts; and a decision module for determining the correlation between the variances and the respective compaction efforts based on a result of learning by the learning module.

10. The system of claim 9 further comprising:

a first location sensor, positioned on the forward end of the compactor, to generate a first location data; and a second location sensor, positioned on the rearward end of the compactor, to generate a second location data, and wherein the controller is operatively coupled to each of the first location sensor and the second location sensor, and wherein the controller is further configured to:

associate the first location data with the first compaction data;

associate the second location data with the second compaction data; and store, in a database, each of the plurality of first compaction data along with the respective first location data, the plurality of second compaction data along with the respective second location data, the determined variances and the determined correlation.

11. A method for operating a compactor for providing a compaction effort over a material of a work area, the method comprising:

receiving, by a controller, a first compaction data associated with the work area from a first compaction sensor positioned on a forward end of the compactor;

determining, by the controller, a first compaction effort based on the first compaction data and a predefined target density of the material after compacting by the compactor;

modifying, by the controller, the first compaction effort based on CMV data generated by a compaction measurement value (CMV) sensor, the CMV data corresponding to a rebound force from the work area to compacting drum of the compactor;

controlling, by the controller, the compactor to compact the material in the work area with the modified first compaction effort to obtain a compacted first portion of the work area;

receiving, by the controller, a second compaction data associated with the compacted first portion from a second compaction sensor positioned on a rearward end of the compactor;

determining, by the controller, a variance between the first compaction data and the second compaction data;

determining, by the controller, a correlation between the determined variance and the modified first compaction effort, the correlation corresponding to an equation indicating how a density of the material in the work area changes with respect to application of the modified first compaction effort by the compactor;

determining, by the controller, a second compaction effort for the work area based on the predefined target density and the determined correlation;

modifying, by the controller, the determined second compaction effort based on the CMV data; and controlling, by the controller, the compactor to compact the material in the work area with the modified second compaction effort.

12. The method of claim 11, wherein the first compaction data corresponds to a density of the work area and the second compaction data corresponds to a density of the compacted first portion of the work area.

13. The method of claim 11, further including:

receiving, by the controller, the target density associated with the work area.

14. The method of claim 11, wherein each of the first compaction effort and the second compaction effort is modified according to one or more of a temperature data associated with the work area and rolling resistance data associated with the compactor.

15. The method of claim 11, wherein determining the first compaction effort and the second compaction effort includes:

determining, by the controller, an amplitude value for a variable vibratory mechanism, a frequency value for the variable vibratory mechanism, and a speed value of the compactor corresponding to each of the first compaction effort and the second compaction effort.

16. The method of claim 15, wherein controlling the compactor to compact the material in the work area with the modified first compaction effort and the modified second compaction effort includes:

modifying, by the controller, one or more of an amplitude of the variable vibratory mechanism, a frequency of the variable vibratory mechanism, and a speed of the compactor to match the amplitude value, the frequency value, and the speed value, respectively, corresponding to the modified first compaction effort and the modified second compaction effort.

17. The method of claim 11, further comprising:

obtaining, by the controller, a plurality of first compaction data, second compaction data, variances between the respective first compaction data and second compaction data, the first compaction effort, and the second compaction effort;

learning, by the controller, by correlating the variances with the respective compaction efforts; and determining, by the controller, the correlation between the variances and the respective compaction efforts based on a result of learning.

18. The method of claim 17, further comprising:

storing, by the controller, in a database, each of the plurality of first compaction data along with a first location data associated with the first compaction data, the second compaction data along with a second location data associated with the second compaction data, the determined variance and the determined correlation.

19. A compactor comprising:

a frame;

a compacting drum operably connected to the frame;

a variable vibratory mechanism coupled to the compacting drum and configured to provide a compaction effort to a work area;

a first compaction sensor positioned on a forward end of the frame;

a second compaction sensor positioned on a rearward end of the frame;

a compaction measurement value (CMV) sensor configured to generate CMV data corresponding to a rebound force from the work area to the compacting drum; and a controller operatively coupled to the first compaction sensor, the second compaction sensor, and the variable vibratory mechanism, the controller being configured to:

receive a first compaction data associated with the work area from the first compaction sensor;

determine a first compaction effort based on the first compaction data and a predefined target density of material in the work area after compacting by the compactor;

modify the determined first compaction effort based on the CMV data;

control the variable vibratory mechanism to perform compaction on the work area with the modified first compaction effort to obtain a compacted first portion of the work area;

receive a second compaction data associated with the compacted first portion from the second compaction sensor;

determine a variance between the first compaction data and the second compaction data;

determine a correlation between the determined variance and the modified first compaction effort, the correlation corresponding to an equation indicating how the density of the material in the work area changes with respect to application of the modified first co action effort;

determine a second compaction effort for the work area based on the predefined target density and the determined correlation;

modify the determined second compaction effort based on the CMV data; and control the variable vibratory mechanism to perform compaction on the work area with the modified second compaction effort.

20. The compactor of claim 19, wherein the controller further includes:

an observation module for obtaining a plurality of first compaction data, second compaction data, variances between the respective first compaction data and second compaction data, the first compaction effort, and the second compaction effort;

a learning module for learning by correlating the variances with the respective compaction efforts; and a decision module for determining the correlation between the variances and the respective compaction efforts based on a result of learning by the learning module.

* * * * *